US006152357A

United States Patent [19]

Schnitzer

[11] Patent Number: 6,152,357

[45] Date of Patent: Nov. 28, 2000

[54] SHIPPING ENVELOPE

[75] Inventor: David H. Schnitzer, Buffalo Grove, Ill.

[73] Assignee: The Standard Register Company, Dayton, Ohio

[21] Appl. No.: 09/224,639

[22] Filed: Jan. 6, 1999

[51] Int. Cl.[7] ..... B65D 27/00; B42D 15/00

[52] U.S. Cl. ..... 229/74; 283/106; 283/62

[58] Field of Search ..... 283/116, 61, 62, 283/79, 81, 106; 229/74

[56] References Cited

U.S. PATENT DOCUMENTS

| | | | |
|---|---|---|---|
| 3,314,592 | 4/1967 | Streich | 229/74 |
| 4,850,613 | 7/1989 | Instance | 283/62 X |
| 4,955,640 | 9/1990 | Anderson | 283/106 X |
| 5,071,167 | 12/1991 | O'Brien | 283/62 X |
| 5,193,850 | 3/1993 | Lombardo | 283/106 X |
| 5,484,170 | 1/1996 | Hatfield, Jr. | 283/81 X |
| 5,520,990 | 5/1996 | Rotermund . | |
| 5,624,069 | 4/1997 | Coats et al. . | |
| 5,735,549 | 4/1998 | Konkol et al. . | |

*Primary Examiner*—Jes F. Pascua
*Attorney, Agent, or Firm*—Killworth, Gottman, Hagan & Schaeff, L.L.P.

[57] ABSTRACT

A shipping envelope comprising first, second and third panels, each having a front and a back, are adjoined side to side adjacent a first fold line between the first and second panels, and a second fold line between the second and third panels. The first panel has fixed information including a return address on the front and a first adhesive on the back to secure the first panel to a shipping container. The second and third panels include one or more areas for printing a delivery address and other variable information. A second adhesive secures the first panel to another panel when the panels are folded along the first and second fold lines so that they overlie the first panel, so that the delivery address is facing out on the envelope. Advantageously, the second and third panels comprise a first ply and the first panel comprises a second ply with the first and second plies overlying one another and secured together by a third adhesive therebetween adjacent the first fold line.

14 Claims, 8 Drawing Sheets

SHIPPING ENVELOPE

TECHNICAL FIELD OF THE INVENTION

This invention relates to the field of shipping labels, and, more specifically, to a shipping envelope affixable to a shipping container on which virtually any printer can print variable information, including the delivery address.

BACKGROUND OF THE INVENTION

In its most basic form, a shipping label is printed with the recipient's name and address and affixed to a shipping container in order to facilitate delivery of the shipping container. Frequently, however, it is advantageous to have more than the delivery address on the outside of a shipping container. For example, it is often desirable to have other variable information, such as a packing list and special instructions, on the exterior of the shipping container. Additionally, shippers frequently want fixed material, such as advertising and the like, to be included with every shipping container. It is also desirable to have a return shipping label included with the shipping container to facilitate returns to the original shipper.

In response to these requirements, shipping labels are generally printed onto forms, inserted into clear plastic envelopes and affixed to the exterior of the shipping container so that the recipient's name and address are visible to package handlers. Such forms are usually multiple layered, especially when advertising is included. Printing the delivery address and other variable information on the inner layers of multi-layers forms requires carbon paper between the layers (or the layers must be made of carbonless paper) and requires that an impact printer print on the outer layer. Impact printers are notoriously slow and unreliable, because the forms must have tractor-feed punched edges that often rip during printing. Further, the print from impact printers can be unclear, even on the outerlayer, and the quality of the print on the inner layer is dependent on the quality of the carbon paper and the force of the impact printer. Printing variable information on some layers and not others requires carbon paper with the ink only in certain sections. Further, it may also be necessary to remove carbon paper layers from a shipping label prior to shipping so as to eliminate the problem of extraneous marks being created on some layers. All of these factors increase the cost of multilayered shipping labels. Further, these labels must then be folded and inserted into the clear plastic envelope, frequently by hand. Therefore, there is a need in the art for a shipping label that can be clearly printed with all desired information and may be affixed to a shipping container with minimal human handling.

One object of the present invention is to provide a shipping envelope that can be printed by virtually any printer, including non-impact printers.

It is another object of the present invention to provide a shipping envelope that may be machine assembled.

It is another object of the present invention to provide a shipping envelope that can contain variable shipment information, such as packing lists, instructions, etc.

It is another object of the present invention to provide a shipping envelope that may be preprinted with fixed information, such as advertising and company identification.

It is another object of the present invention to provide a shipping envelope that includes a return label to facilitate returns to the sender.

It is a further object of the present invention to provide a one-piece, multi-purpose shipping label for ease of handling.

SUMMARY OF THE INVENTION

A shipping envelope is provided which may be printed with the delivery address and other variable information by most printers and then easily folded into the shipping envelope and affixed to a shipping container. In accordance with a preferred embodiment of this invention, first, second and third panels, each having a front and a back, are adjoined side to side by a first fold line between the first and second panels, and a second fold line between the second and third panels. The first panel has fixed information including a return address on the front and a first adhesive on the back to secure the first panel to the shipping container. The second and third panels include one or more areas for printing a delivery address and other variable information. A second adhesive, along a side of one of the panels, is adapted to secure that panel to another panel when the panels are folded along the first and second fold lines so that they overlie the first panel with the delivery address facing out on the envelope. Advantageously, the second and third panels comprise a first ply and the first panel comprises a second ply, wherein the first and second plies overlie one another with a third adhesive therebetween adjacent to the first fold line.

DETAILED DESCRIPTION OF THE INVENTION

Figure 1:
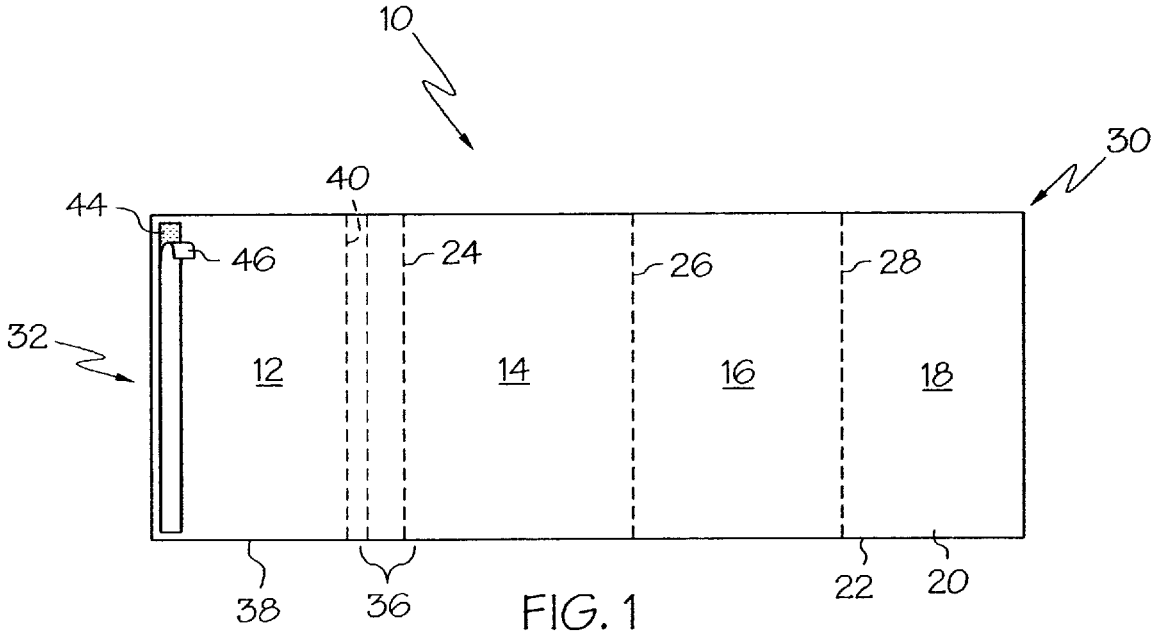
FIG. 1 is a front view of an unfolded shipping envelope according to an exemplary embodiment of the invention.
Figure 2:
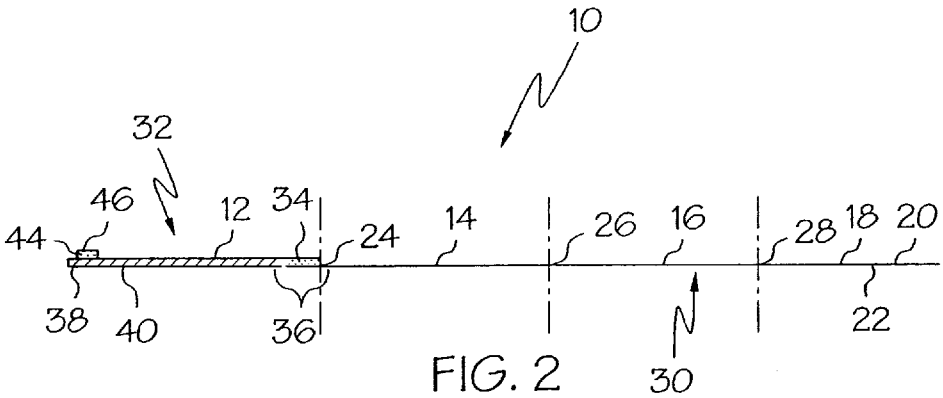
FIG. 2 is a side view of the unfolded shipping envelope of FIG. 1.

Turning to FIGS. 1 and 2, an exemplary embodiment of a shipping envelope is shown generally at 10. Shipping envelope 10 comprises a plurality of adjoining panels, illustrated here as four panels, 12, 14, 16 and 18, each having a front 20 and a back 22. The panels adjoin along fold lines 24, 26 and 28, which are advantageously perforated. Perforations facilitate removing individual panels and detaching the panels from each other. Fold lines 24, 26 and 28 may also be scored lines, or simply marks for folding.

In the illustrative embodiment of FIG. 1, the second 14, third 16 and fourth 18 panels comprise a first ply 30. Ply 30 may be paper, pasteboard, cardboard or other material depending upon the use. First panel 12 comprises a second ply 32, which may also be paper, pasteboard, cardboard, etc. The first 30 and second 32 plies are joined by an adhesive 34 along overlap 36. Alternatively, shipping envelope 10 may be a single ply.

First panel 12 includes an adhesive 38 on its back to secure shipping envelope 10 to a shipping container. Adhesive 38 may be a continuous layer of adhesive with adhesive 34. Alternatively, adhesives 34 and 38 may be separate layers of the same or differing adhesive materials. The adhesive illustrated is pressure sensitive adhesive, with a release liner 40 thereon to prevent shipping envelope 10 from jamming or otherwise gumming up a printer, although other adhesives could be used within the scope of the invention. Release liner 40 is removable for attachment of shipping envelope 10 to a shipping container (not shown).

An adhesive strip 44 is applied to one edge of the first panel 12 to hold the envelope closed when folded. Adhesive strip 44 may be a pressure sensitive strip with a release liner 46. Alternatively, adhesive strip 44 could be a remoistenable adhesive.

Figure 3:
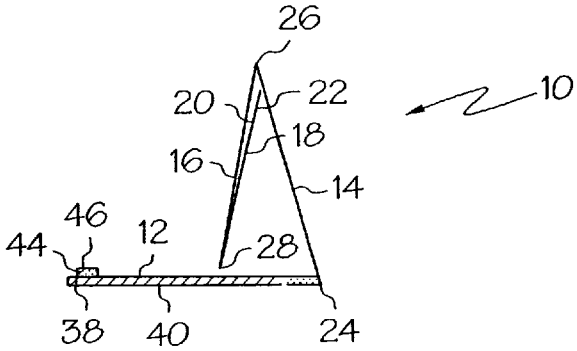
FIG. 3 is a folding diagram of the shipping envelope of FIG. 1.

Panels 14, 16 and 18 are folded one over another to overlie panel 12. Adhesive strip 44 holds panels 14, 16 and 18 to panel 12, after release liner 46 is removed, to form shipping envelope 10. Specifically, as shown in FIG. 3, panel 18 is folded at line 28 so that its front is next to the front of panel 16. Panel 16 is folded along line 26 so that the back of panel 18 is next to the front of panel 14. Panel 14 is folded on line 24 so that the second 14, third 16 and fourth 18 panels overlie the first panel 12. When folded, the front of panel 14 is next to the back of panel 18 and the back of panel 16 is on top of the front of panel 12. Once shipping envelope 10 is folded, it is sealed to itself by adhesive strip 44 adhering the front of panel 12 to the back of panel 16. Alternatively, a glue seal or heat seal may be used. Preferably, existing card or paper folding machines can accomplish the folding and sealing. In this manner, an envelope is formed.

Figure 4:
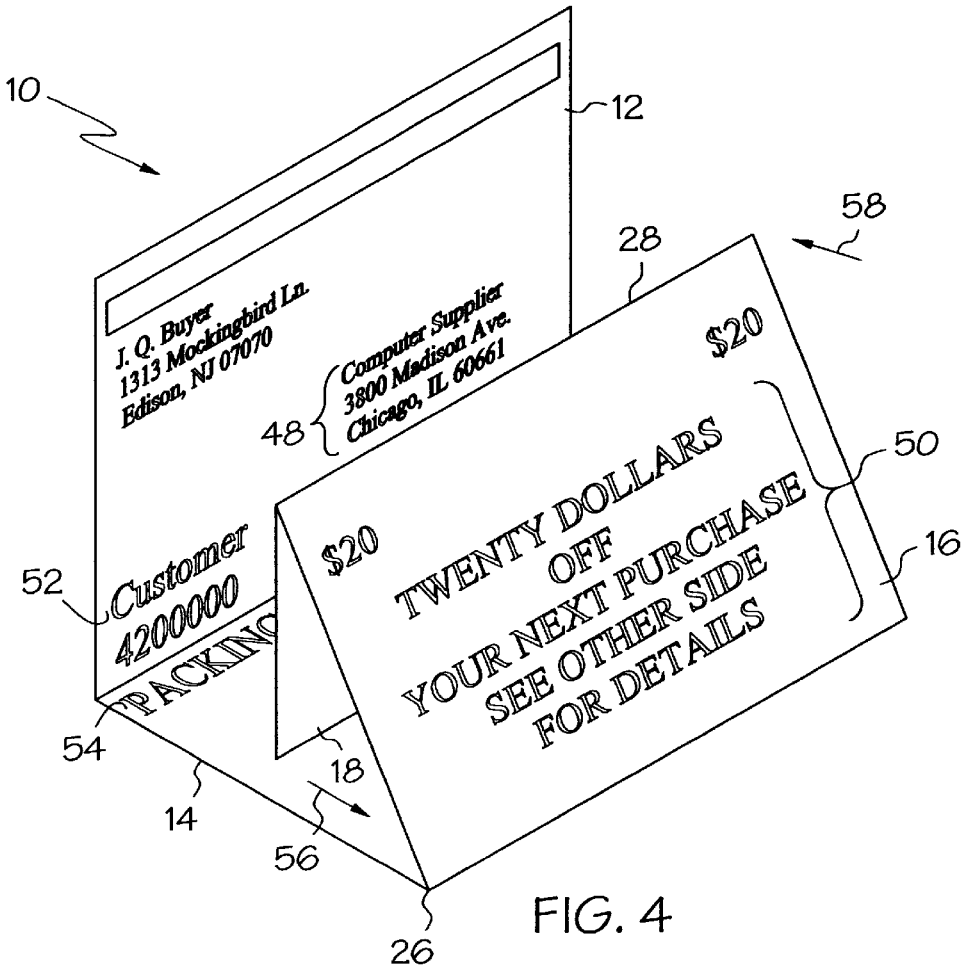
FIGS. 4 and 5 illustrate the shipping envelope of FIG. 1 as it is folded.

Turning now to FIG. 4, an exemplary embodiment illustrating one potential use of this shipping envelope is shown. In this embodiment, shipping envelope 10 is preprinted with information that the shipper wants to send to all recipients ("constant" or "fixed" information). For example, the shipper's return address 48 and advertising, coupons and/or other information 50 are preprinted. Because the shipping label initially comprises a sheet, it may be further printed with variable information including indicia 52 marking a delivery address, customer numbers, shipment number, customer return address, etc. using most any sheet-feed printer or other printer or printing press. Further, a packing list 54 specific to the content of the shipping container may be printed either simultaneously with the indicia 52 or at a separate time.

In this exemplary embodiment, a computer supplies company may, for example, be sending computer parts to a purchaser. The envelope manufacturer supplies the computer supplies company with unfolded envelopes preprinted with the company's name and/or logo, as at 48 on the first panel 12 along with other information 50. The computer supplies company then itself prints the unfolded envelope 10 with variable indicia 52 specific to the shipment to the purchaser. Panel 18 is then folded at line 28 against panel 16, as shown by arrow 56. Panels 16 and 18 are then folded against panel 14, as shown by arrow 58.

Figure 5:
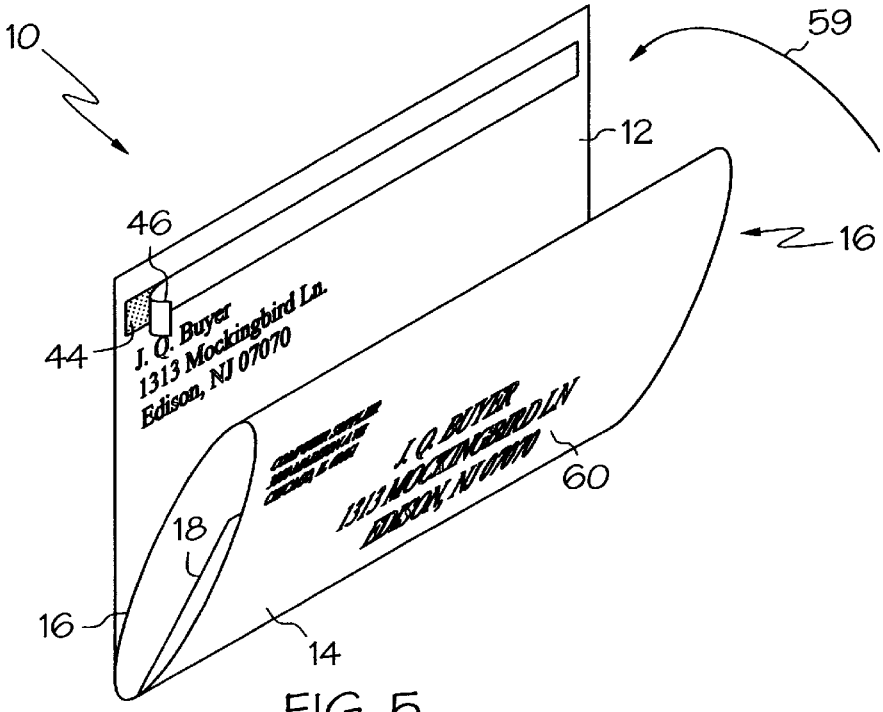

Turning now to FIG. 5, a shipping envelope according to this invention is shown as it is being finally folded. Panels 18, 16, and 14 are folded to overlie panel 12, as shown by arrow 59. Once folding is completed wherein the panels overlie, the panels are secured in their folded position by adhesive strip 44. Shipping envelope 10 is ready for use, and can be affixed to a shipping container by adhesive 38 (not shown in FIG. 5). Note that shipping address 60 is printed on the back of panel 14, so that it is visible to package handlers after shipping envelope 10 is folded.

After the purchaser receives the package, the purchaser opens shipping envelope 10 along perforated fold lines 24, 26 and 28. Panel 12 remains affixed by adhesive 38 to the container. The purchaser can use the same shipping container to ship defective or unaccepted merchandise without having to relabel the shipping container as panel 12, which contains the return address, is exposed when the shipping envelope 10 is opened.

Figure 6:
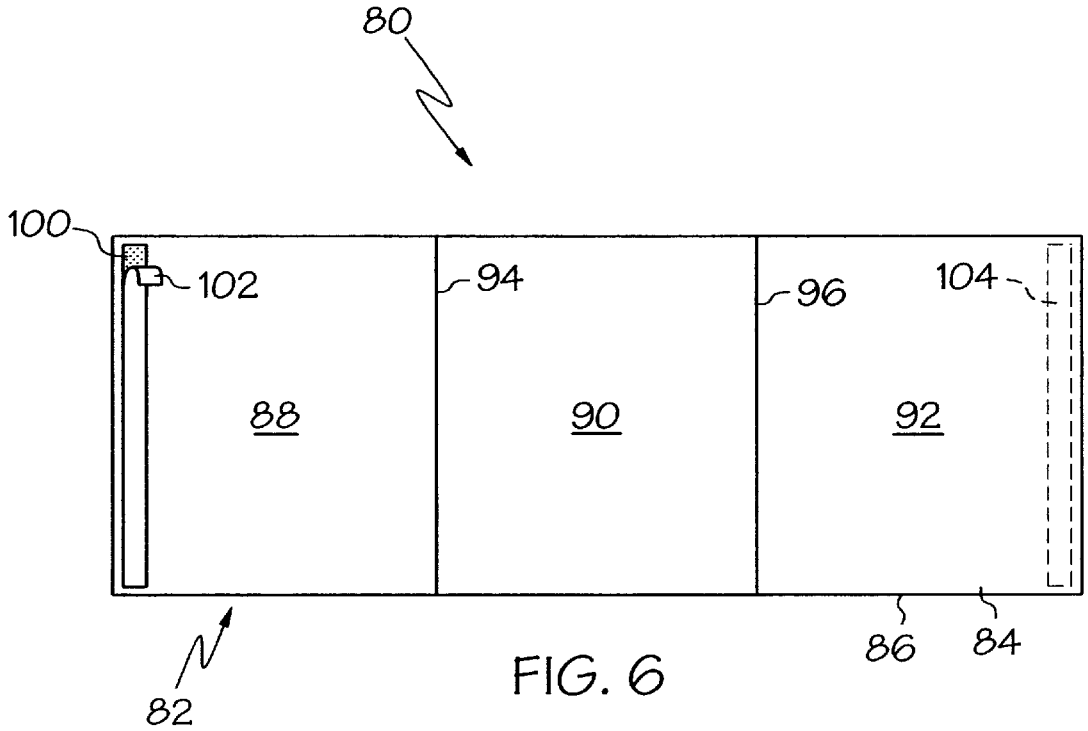
FIG. 6 is a further exemplary embodiment of this shipping envelope.
Figure 7:
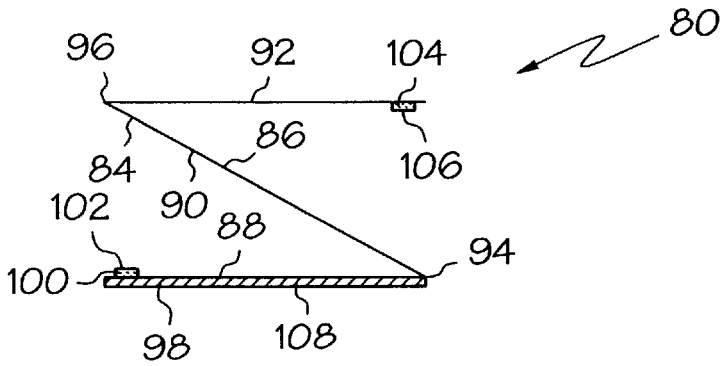
FIG. 7 is a folding diagram of the embodiment of the shipping envelope of FIG. 6.
Figure 8:
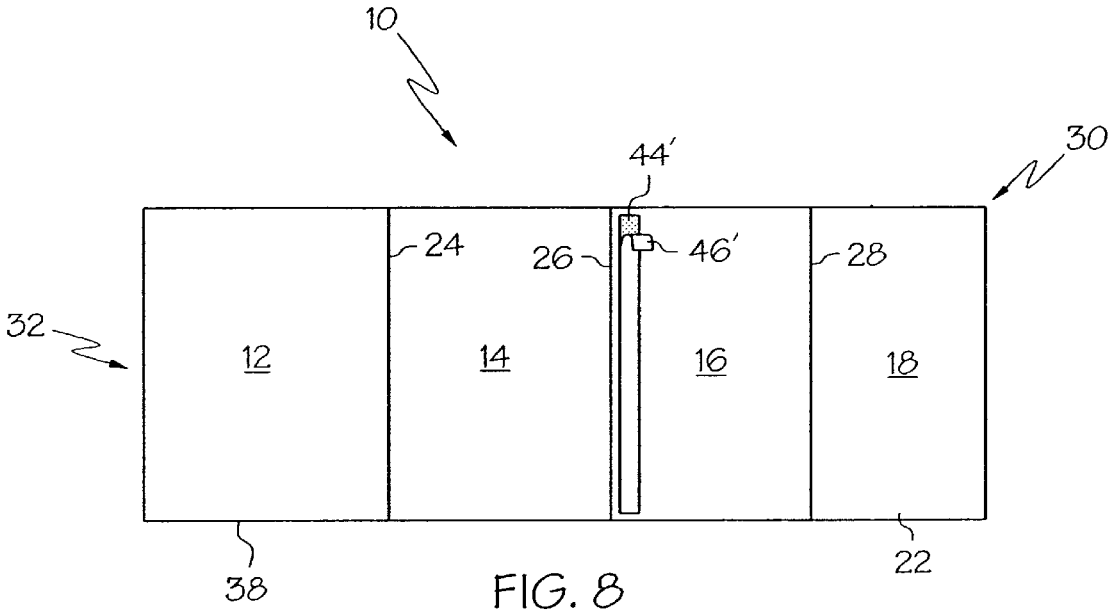
FIG. 8 is a front view of an unfolded shipping envelope according to another embodiment of the invention.
Figure 9:
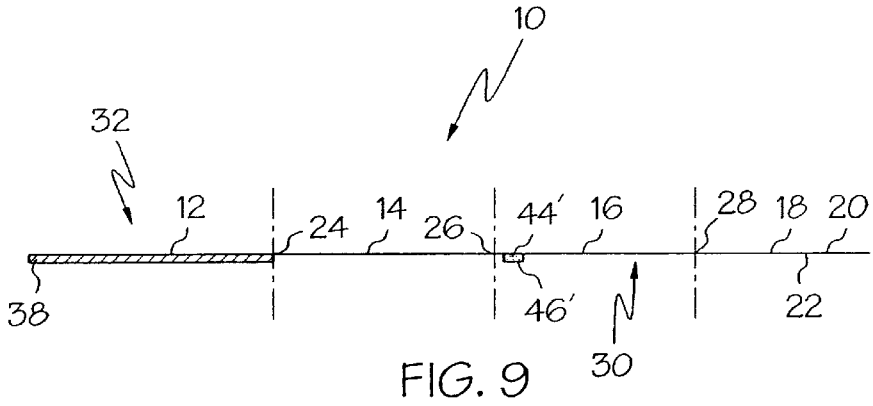
FIG. 9 is a side view of the shipping envelope of FIG. 8.

Turning now to FIGS. 6 and 7, a further exemplary embodiment of a shipping envelope is shown generally at 80. In this exemplary embodiment, a single ply 82, having a front 84 and a back 86, is divided into three panels 88, 90 and 92 by fold lines 94 and 96. Panel 88 may also be a first ply, and panels 90 and 92 may be a second ply, with the two plies having an overlap secured together by an adhesive, as in the first exemplary embodiment. Ply 82 has pressure sensitive adhesive 98 with a release liner 108 on the back of panel 88 for affixing the shipping envelope 80 to a shipping container. Adhesive strip 100, such as a pressure sensitive strip with release liner 102 (or other adhesives, such as a remoistenable adhesive) is affixed to the front of panel 88. A second adhesive strip 104 is affixed to the back of panel 92 (shown in phantom).

FIG. 7 depicts folding the shipping envelope of FIG. 6. Panel 92 is folded at line 96, and panel 90 is folded at line 94 so that panels 90 and 92 overlie panel 88 in a zig-zag shape. The panels are then affixed to each other by adhesive strips 100 and 104 (after release liners 102, 106 are removed) at the edges to form a shipping envelope 80. After release liner 108 is removed, shipping envelope 80 may be affixed to a shipping container.

Figure 10:
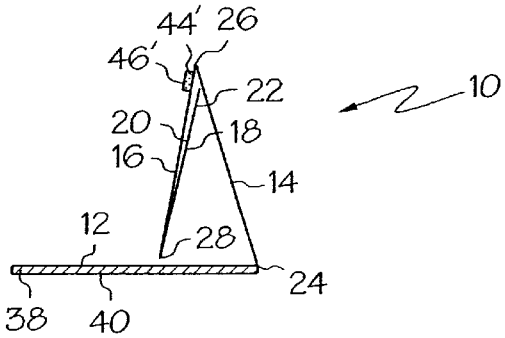
FIG. 10 is a folding diagram of the shipping envelopes of FIG. 8.
Figure 11:
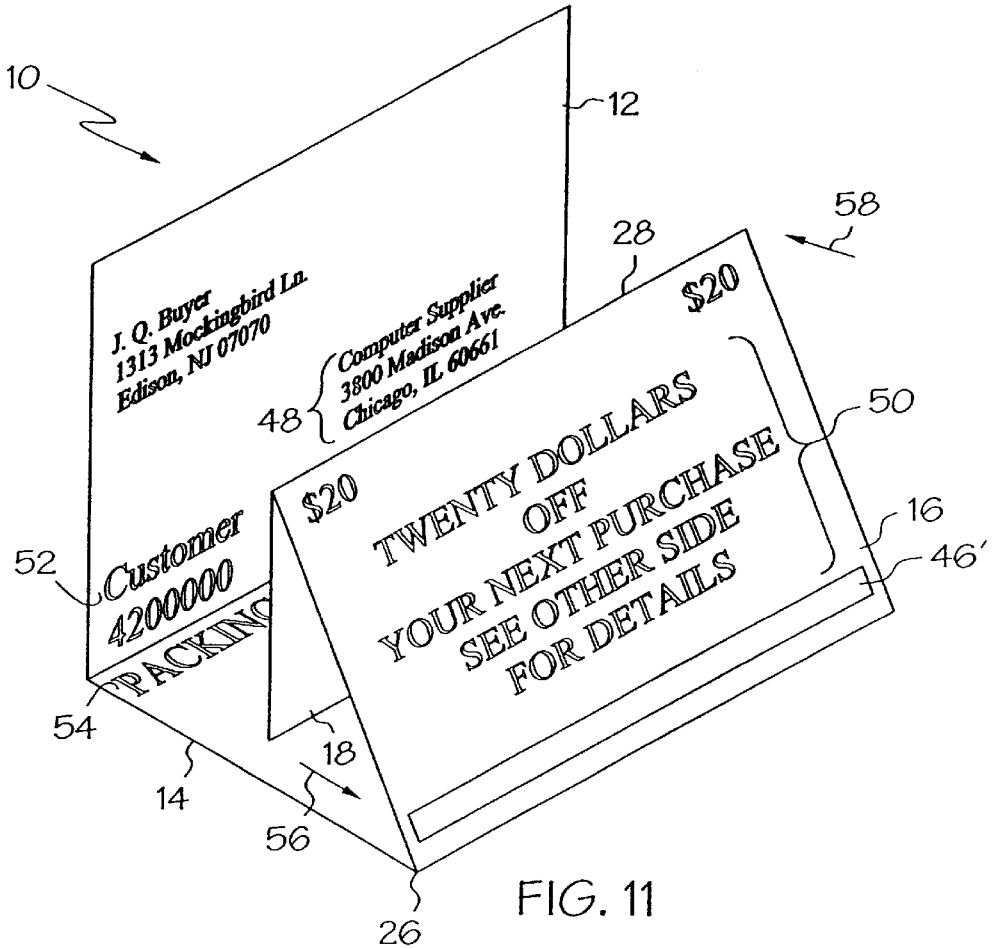
FIGS. 11 and 12 illustrate the shipping envelope of FIG. 8 as it is folded.
Figure 12:
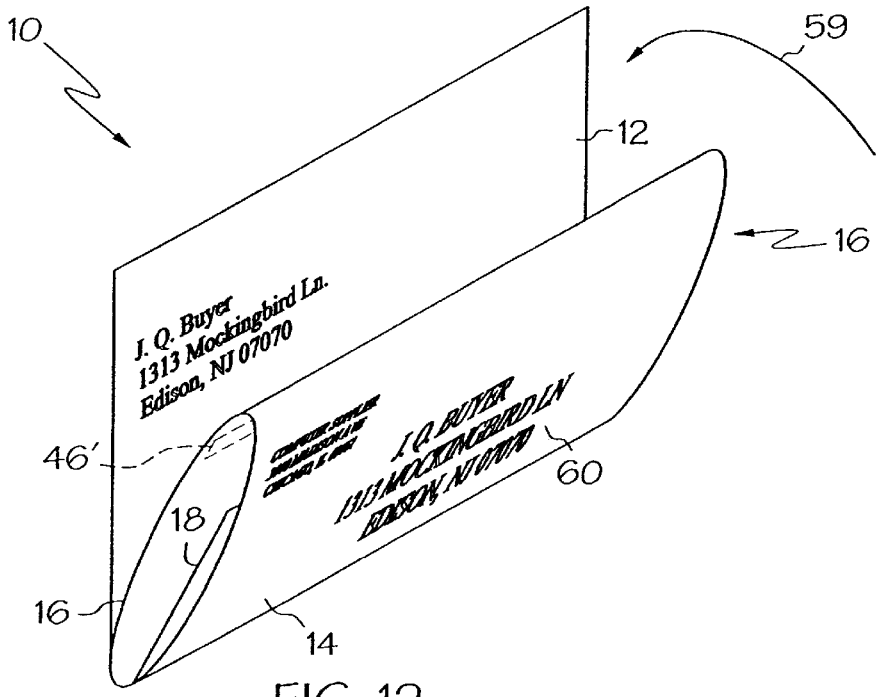

Reference is now made to FIGS. 8–12, which illustrate an embodiment of the invention which is somewhat similar to the embodiment of FIGS. 1–5. Reference numerals have been used in FIGS. 8–12 to refer to structure that corresponds to similar shown in FIGS. 1–5. Comparing the two embodiments reveals that the sole difference is that the adhesive strip 44 and release liner 46 of FIGS. 1–5 have been moved to the third panel 16, adjacent fold line 26, as referenced by numerals 44' and 46'. As shown in FIGS. 10–12, the manner in which the shipping envelope folded is precisely the same as that used with the embodiment of FIGS. 1–5. By comparing FIGS. 2 and 9 it will be noted that the embodiment of FIGS. 8–12 has the advantage of a thinner panel 12, since this panel carries adhesive and a release liner on only one side.

Figure 13:
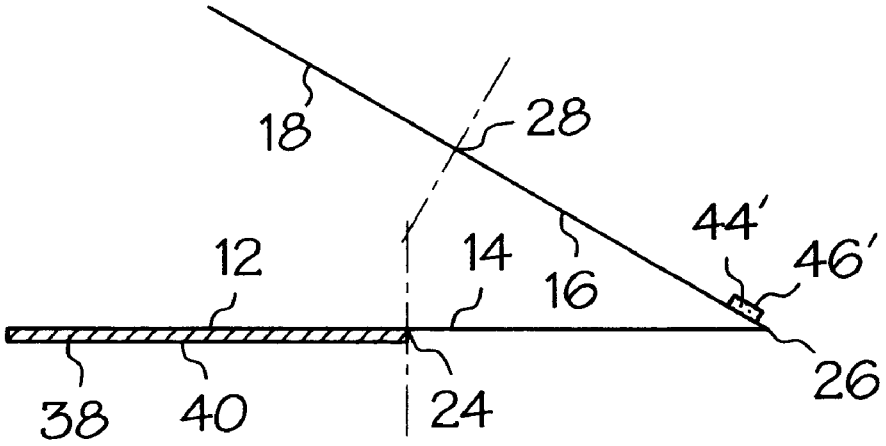
FIGS. 13 and 14 are side views depicting folding yet another embodiment of the shipping envelope of the present invention.
Figure 14:
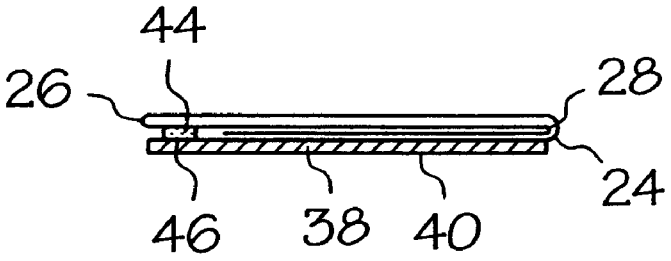

A further embodiment of the shipping envelope of the present invention is shown in FIGS. 13 and 14. This embodiment is substantially the same in construction as that of FIGS. 8–12. It will be noted, however, that the manner in which the envelope is folded differs slightly. In the embodiment of FIGS. 13 and 14, the initial fold is at fold line 26, with the third and fourth panels 16 and 18 overlying the second and first panels 14 and 12, respectively. Next, the panels are folded at fold lines 24 and 28, as shown in FIG. 14, and the envelope sealed by means of adhesive 44' securing the third panel 16 to the first panel 12. The only difference between the construction of the embodiment of FIGS. 13 and 14 and that of FIGS. 8–12 which is required is that, as will be apparent from inspecting FIG. 14, the width of the panel 18 must be less than the width of the panel 12 by a distance at least equal to the width of the adhesive strip 44' so as to permit strip 44' to contact the first panel 12, and seal the envelope.

Figure 15:
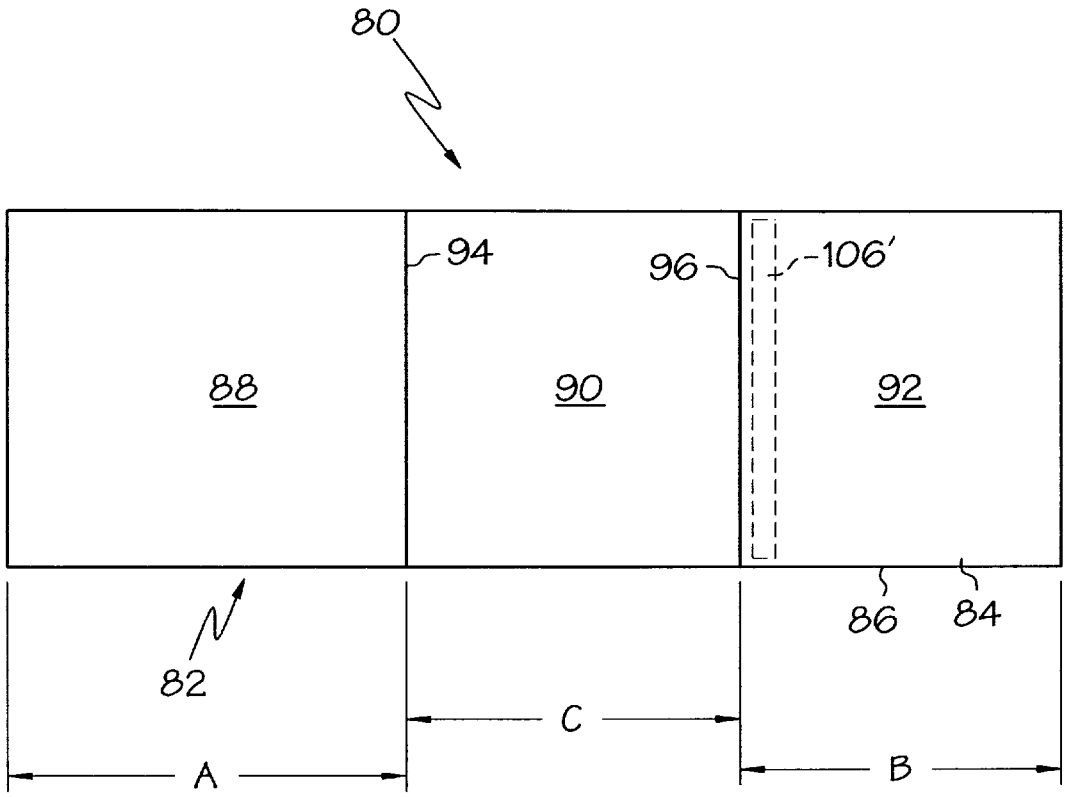
FIG. 15 is a front view of another embodiment.
Figure 16:
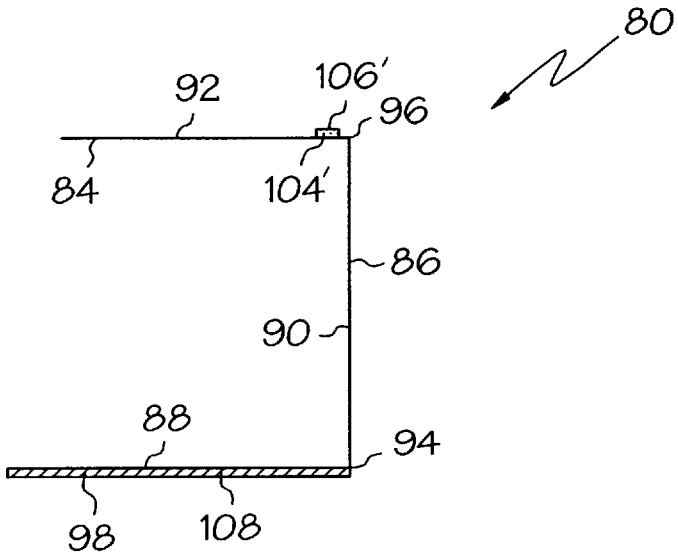
FIGS. 16 and 17 are views showing folding of the embodiment of FIG. 15.
Figure 17:
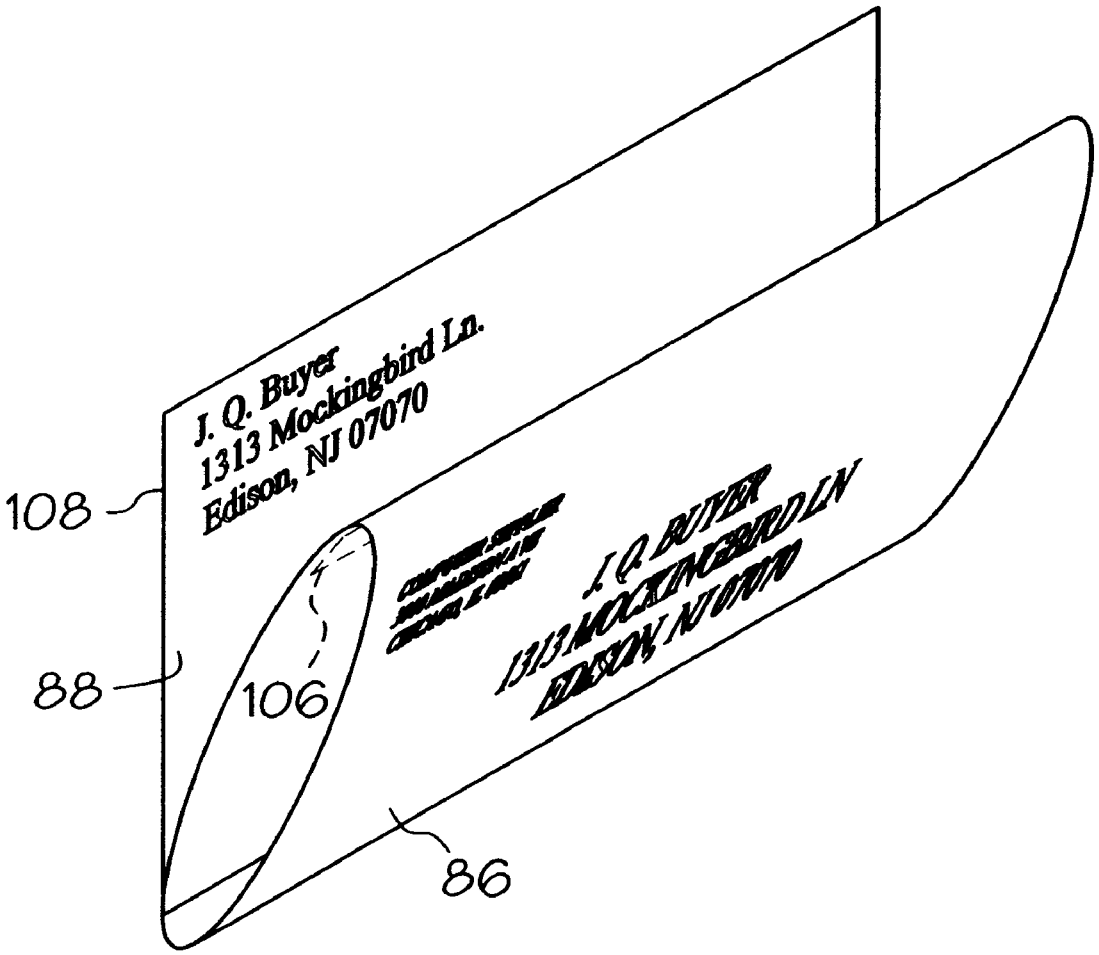

Finally, FIGS. 15–17 illustrate an embodiment of the shipping envelope which is similar to that of FIGS. 6 and 7. Corresponding structure in FIGS. 15–17 has been designated by corresponding reference numerals. The only difference in structure between the embodiment of FIGS. 15–17 and that of FIGS. 6 and 7 is that the adhesive strip 104' and release liner 106' have been moved to the portion of panel 92 which is adjacent fold line 96. The change in position of the adhesive 104' and release liner 106' permits the envelope to be folded in a C-fold, as shown in FIG. 16. The completion of the fold is illustrated in FIG. 17. As will be noted, the shipping address is moved to the back of panel 86 so that it will be visible after the envelope is attached to a container.

It is to be understood that many variations may be devised by those skilled in the art. It is, therefore, intended that such variations be included within the scope of the following claims:

What is claimed is:

1. A shipping envelope for attachment to a shipping container comprising:

first, second and third panels adjoined side to side, said panels each having a front and a back, said first panel being adjoined to said second panel by a first fold line and said second panel being adjoined to said third panel by a second fold line;

a first adhesive on the back of said first panel for securing said first panel to a shipping container;

information, including a return address, printed on the front of the first panel;

at least one of said second and third panels including a delivery address printed thereon;

a second adhesive along a side of one of said panels, said second adhesive adapted to secure said one of said panels to another of said panels when said panels are folded along their adjoining fold lines with both said second and third panels overlying said first panel and said delivery address facing outwardly on said envelope.

2. The shipping envelope of claim 1, wherein said second and third panels comprise a first ply and said first panel comprises a second ply, said first and second plies overlying one another with a third adhesive therebetween adjacent said first fold line.

3. The shipping envelope of claim 2, wherein said first ply comprises a first material, and said second ply comprises a second material.

4. The shipping envelope of claim 1, further comprising a fourth panel adjoined side to side to said third panel by a third fold line, wherein said second adhesive is adapted to secure the front of said first panel to the back of said third panel adjacent said second fold line when said panels are folded.

5. The shipping envelope of claim 4, wherein said delivery address is printed on the back of said second panel.

6. The shipping envelope of claim 1, wherein said first adhesive comprises a pressure sensitive adhesive with a release liner thereon, said release liner being removable therefrom to expose said first adhesive for securing said first panel to a shipping container.

7. The shipping envelope of claim 1 wherein said first and second fold lines comprise perforations.

8. The shipping envelope of claim 1, wherein at least one of said second and third panels includes a second area for printing variable information.

9. The shipping envelope of claim 1 further comprising further fixed information printed on at least one of said second and third panels.

10. A shipping envelope for attachment to a shipping container comprising:

first and second plies, each having a front and a back, and transverse strips overlying one another and secured together by a first adhesive;

a first fold line adjacent said transverse strips;

said first ply forming a first panel;

said second ply formed into second, third and fourth panels by a second fold line between said second and third panels, and a third fold line between said third and fourth panels;

a second adhesive on the back of said first panel for securing said first panel to a shipping container;

areas on both said first and second plies for printing fixed information, including a return address;

said second ply including a delivery address printed thereon;

a third adhesive along a side of said first panel, said third adhesive adapted to secure said first panel to said third panel for securing said second, third and fourth panels over said first panel with said delivery address facing outwardly on said envelope.

11. The shipping envelope of claim 10, wherein said area for printing a return address is on the front of said first panel.

12. The shipping envelope of claim 10, wherein said delivery address is printed on the back of said second panel.

13. The shipping envelope of claim 10, wherein said second adhesive comprises a pressure sensitive adhesive with a release liner thereon, said release liner being removable therefrom for exposing said first adhesive for securing said first panel to a shipping container.

14. A folded shipping envelope for attachment to a shipping container comprising:

first, second, third and fourth panels adjoined side to side, said panels each having a front and a back; said second, third and fourth panels being adjoined by fold lines;

a first adhesive on the back of said first panel for securing said first panel to a shipping container;

said second panel including a delivery address printed thereon;

a second adhesive along a side of said first panel;

said shipping envelope being folded such that said second, third and fourth panels are folded along their adjoining fold lines such that said second, third and fourth panels overlie said first panel and are adhered to said first panel by said second adhesive, and wherein said delivery address printed on said second panel faces outwardly on said envelope.

* * * * *